US005098219A

United States Patent [19]

Harrington

[11] Patent Number: 5,098,219

[45] Date of Patent: Mar. 24, 1992

[54] MOBILE SUBMERSIBLE CAISSON FOR UNDERWATER OIL-WELL DRILLING AND PRODUCTION

[75] Inventors: James V. Harrington, 19 Dolphin Rd., Groton, Conn. 06340;

[73] Assignees: James V. Harrington, Groton, Conn.; Frank P. Davidson, Concord, Mass.; William L. Bohannan, Groton, Conn.

[21] Appl. No.: 544,037

[22] Filed: Jun. 26, 1990

Related U.S. Application Data

[63] Continuation of Ser. No. 358,587, May 30, 1989, abandoned.

[51] Int. Cl.[5] ..... B64C 11/40; E21B 7/124; E21B 7/132; E21B 43/01

[52] U.S. Cl. ..... 405/8; 166/356; 175/9; 405/193; 405/206; 405/207

[58] Field of Search ..... 166/356, 352, 338, 358, 166/339, 351; 175/5, 8, 9, 10; 405/8-10, 189, 193, 200, 203, 207, 206

[56] References Cited

U.S. PATENT DOCUMENTS

| | | | |
|---|---|---|---|
| 3,063,507 | 11/1962 | O'Neill et al. | 166/358 |
| 3,294,185 | 12/1966 | O'Neill et al. | 166/358 |
| 3,512,583 | 5/1970 | James | 405/193 X |
| 3,552,903 | 1/1971 | Townsend | 166/356 |
| 3,602,301 | 8/1971 | James | 175/5 |
| 3,621,911 | 11/1971 | Baker et al. | 166/356 |
| 3,640,079 | 2/1972 | Le Therisien et al. | 405/189 |
| 3,642,063 | 2/1972 | Jergins | 166/356 |
| 3,646,771 | 3/1972 | Greene | 405/189 |
| 3,661,204 | 5/1972 | Blanding et al. | 166/356 |
| 3,709,307 | 1/1973 | Clark | 175/8 |
| 4,010,798 | 3/1977 | Corgnet | 166/356 |
| 4,054,104 | 10/1977 | Haselton | 166/356 |
| 4,103,500 | 8/1978 | Nobileau et al. | 405/193 |
| 4,108,255 | 8/1978 | Smith | 175/9 |
| 4,442,900 | 4/1984 | Padilla et al. | 166/356 |
| 4,502,551 | 3/1985 | Rule et al. | 166/356 |
| 4,753,552 | 6/1988 | Karal et al. | 405/189 |

*Primary Examiner*—Stephen J. Novosad

[57] ABSTRACT

A mobile submersible caisson is employed to drill for and recover petroleum products from subsea wells and to deliver the products to shore or to vessels at the well site. The well drilling technique applies to water depths beyond 300 ft. and in areas where severe winds, waves, spray and frigid atmosphere can cause long downtime or make it impossible to maintain the positions of surface platforms for extended periods of time. Caissons containing drilling, completion, workever, separation, pumping and compressing equipment are towed to sea in the caisson in the horizontal position. At the work site the caisson is erected, connects an attached wire cable to a platform placed on the sea bottom, and is submerged and winched down. The caisson mates and becomes sealed with the platform, providing a one atmosphere working space for the drilling crew. Water between the caisson and the platform is pumped out so this area can also be used as a work area. Drilling control crews are rotated between the sea surface and the caisson at designated intervals while the caisson remains in place. When the caisson completes the drilling operation it is disconnected and ballasted such that it departs the platform and surfaces to be restocked from a ship or towed back to a pier for restocking. Other caissons, having other work functions, can then move to the undersea platform site to carry on other programmed activities.

1 Claim, 6 Drawing Sheets

MOBILE SUBMERSIBLE CAISSON FOR UNDERWATER OIL-WELL DRILLING AND PRODUCTION

This is a continuation of copending U.S. patent application Ser. No. 07/358,587, filed May 30, 1989, now abandoned.

BACKGROUND OF THE INVENTION

The present invention is directed to underwater drilling and transportation of petroleum products from mobile submersible caissons which rest sequentially upon a platform placed on the sea bottom as various work functions are completed in turn by the various type caissons.

The cost of drilling oil wells from platforms at the sea surface increases as the depth of water becomes progressively deeper. Drilling now takes place at water depths in excess of one thousand feet and is progressing to twenty five hundred feet. The longer the drill string from the surface to the bottom the more materials which are consumed and the more time required prior to intiating the drilling activity. As a consequence, any method for reducing this delay and material expenditures has the effect of reducing the cost of the project.

The process of drilling from the surface in areas where seas are continually rough and often stormy, cold and in darkness for long periods of time is also very costly.

It is the object of the present invention to reduce well drilling time by submerging a mobile submersible caisson onto a platform placed on the sea bottom. The submerging process involves ballasting the caisson to lower the buoyancy until the remaining buoyancy can be overcome by the winch mechanism and the caisson slowly lowered down and sealed to the platform.

Another object of the present invention is to eliminate a moored platform and its cables, chains and anchors on and beneath the sea, thereby eliminating a costly obstruction at the site.

It is a further objective to provide the caisson with one atmosphere of air pressure, processed and recycled for the well-being and comfort of the crew and not subject to difficult weather conditions at the surface. Easy entry and exit to and from the caisson by means of a bell type work chamber or small submersible is provided.

SUMMARY OF THE INVENTION

The foregoing and related objects are achieved in a method of of drilling and producing oil wells by a means that includes providing a mobile submersible caisson resting on and capable of being sealed to a previously placed platform resting upon the sea bottom.

Annular tanks integral with the caisson structure contain water that ballasts the caisson in the horizontal position when moving from a port or from one worksite to another and reballasts the caisson to the vertical position at the worksite by redistributing the water in the annular tanks and adding sea water if additional ballast is required.

Appropriate machinery and equipment are installed in a caisson outfitted to conduct the particular phase of activity in the program ongoing at the moment. Other machinery and equipment are installed to provide life support systems and habitability features for the well being of the crew during their stay in the caisson.

The preset platform installed in place and anchored permanently to the sea bottom is designed as a deep dish to provide an equipment space and also a working space when the caisson is sealed to the platform. The equipment attached to the platform consists of completion equipment and various valves and controls that manage the flow and operations of the drilling and producing equipment assemblage. The platform acts as the foundation for various types of caissons that will rest upon it during the times when drilling and producing activities are occurring.

Power is necessary to run the various machines and equipment in the caisson and it is provided from either a power plant at the surface, from the shore by cables, or a nuclear power plant incorporated either in the caisson or connected separately with the caisson. Cables from the shore or from the sea surface enter the system by way of the platform.

A drilling caisson will contain sufficient drill string and tubing material to complete one well. In the event that other wells will be drilled at the same site the caisson can be replenished at the sea surface or the caisson taken back to a pier and reloaded with consumables to drill another well. The crew can be replaced with a relief crew to initiate the drilling of the next well. When the drilling process is completed by the drilling caisson, a caisson containing production equipment such as gas-/oil separators, pumps and compressors will replace the drilling caisson, and will manage the delivery of the product to shore or to the sea surface by appropriate flow lines. This production caisson may be unmanned after it is set in place, the machinery tested and operating properly if equipped with remote or automatic controls.

The invention is defined in more detail in the appended claims.

BRIEF DESCRIPTION OF THE DRAWINGS

These and further features and advantages of the present invention are described using the attached drawings in which.

DETAILED DESCRIPTION OF THE PREFERRED EMBODIMENT

Figure 1:
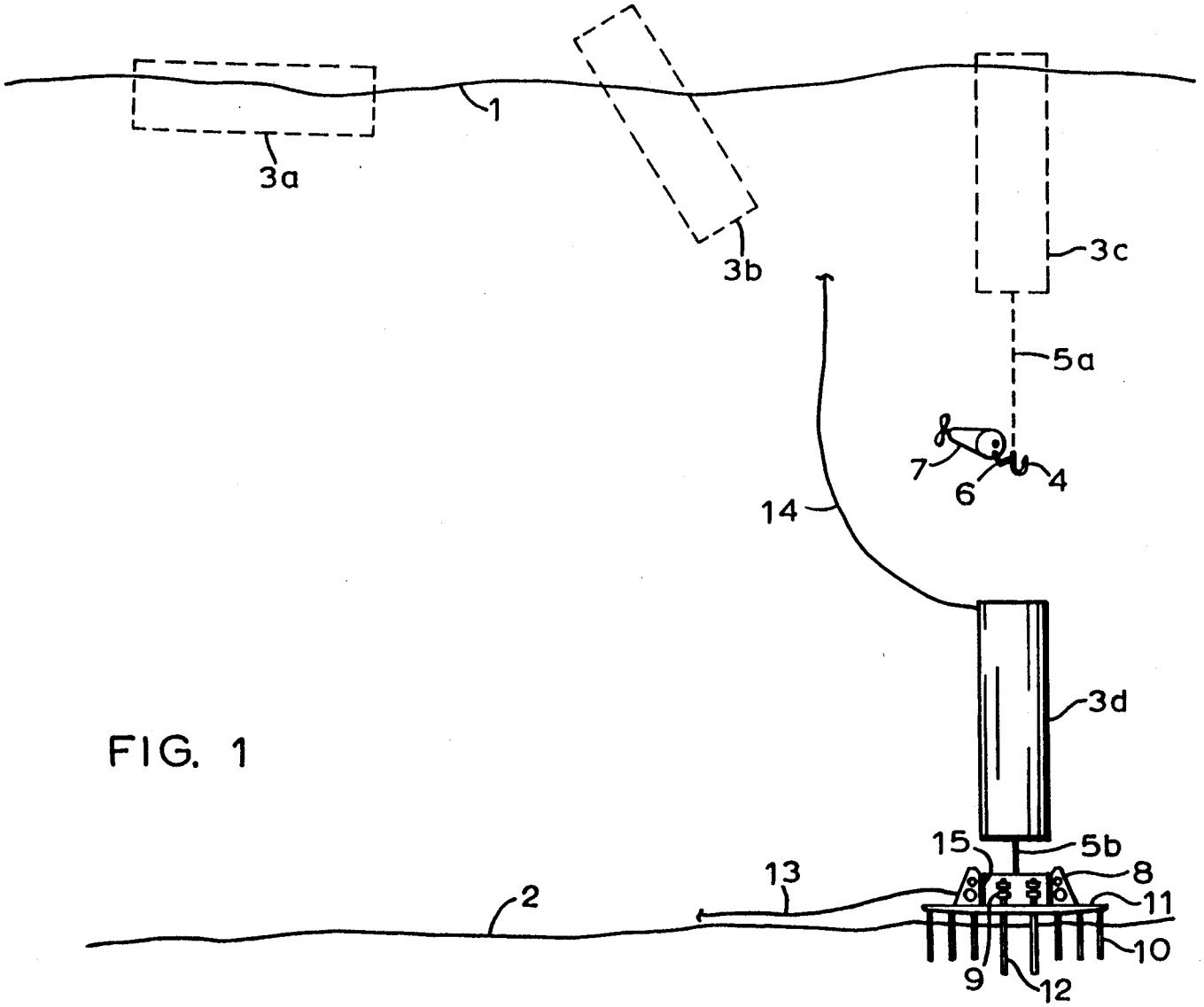
FIG. 1 is an overview of the assembly of the caisson, the preset platforms and other items necessary to drill and produce oil and gas by the mobile submerged caisson process.
Figure 2:
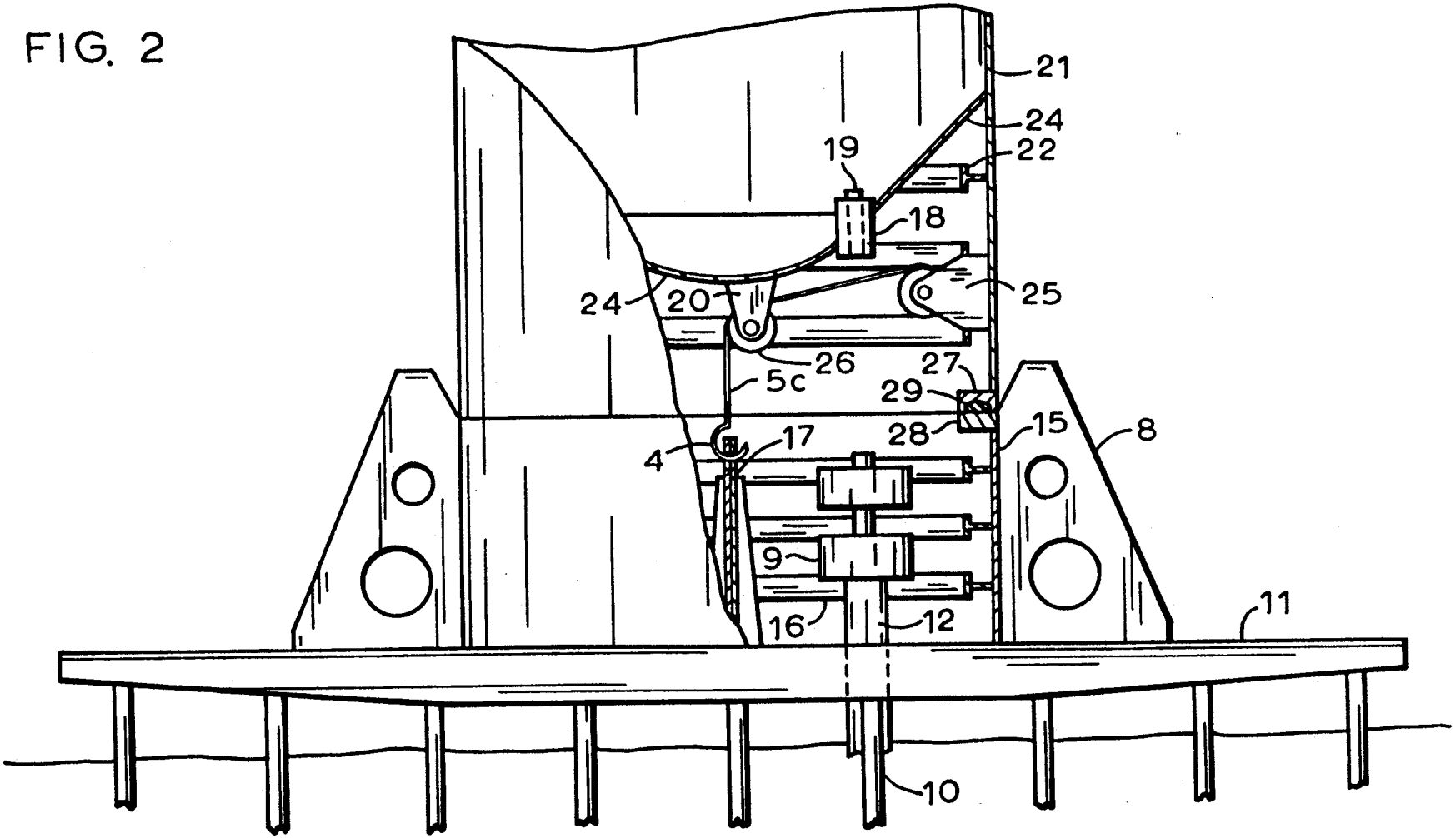
FIG. 2 is a cross sectional view of the lower portion of the caisson resting upon the preset platform in a seated and sealed position. Structural details of the caisson and platform are shown and the downhaul winch, blowout preventers and padeye are shown.

FIG. 1 shows the equipment necessary to drill oil wells by means of the mobile submersible caisson method. The sea surface (1) is shown at the top and the sea bottom (2) is shown at the bottom. The caisson (3*a*) is shown in the horizontal position on the surface, having been brought to the well site by a tow boat. Next, the caisson (3*b*) is shown in the partially erected position as it is moving to the vertical position by ballasting lower internal tanks inside the caisson. The caisson (3*c*), now in the vertical position, adds water ballast to the lower tanks in the caisson until it attains a slight positive buoyancy. It then extends cable (5*a*) with hook (4) at its end so that a remote operating vehicle (ROV) (7) carrying a manipulator (6) can capture the hook on the cable and pull it down and connect it to a large padeye in the preset platform (11). Having made the connection, the ROV departs the area. The caisson (3*b*) is now hauled down by cable (5*b*) where it will be seated and sealed on the platform.

The platform is attached to and supported on piles (10) driven into the sea bottom. The preset platform is designed like a dish, having a flat bottom structure (11) supporting a cylindrical wall (15) and further supported external stiffeners attached both to the bottom structure and the cylindrical wall. Blow out preventor (9) and casings (12) are incorporated in the platform. When the caisson is seated and sealed on the top of the cylindrical wall, the seawater inside of the dish is pumped out and filled with one atmosphere of air, thus providing a work space and direct access to the dish area around the well heads and the completion equipment.

Electric power must be provided to the system to operate the machinery. A cable (13) laying on the sea bottom conducts electric power from the shore, or a source on the sea surface, to the platform. The cable termination is in a panel in the dish area. After the caisson is sealed on the platform it is connected to the panel and receives power for all the equipment it contains. An alternate method provides a cable (14) from the caisson to the sea surface where a shipboard power plant provides electricity to the top of the caisson.

FIG. (2) provides more detailed information on both the preset platform and the lower portion of the caisson and shows the seating and sealing elements. Elements (4), (5*b*), (8), (9), (10), (11), and (12) are repeated from FIG. 1 showing the structure of the platform, the blowout preventor and the casing below the preventor. Stiffeners (16) are welded to the cylindrical shell to prevent the collapse of the shell wall under deep sea pressure. Haul down winch (25) and idler pulley (26) control the haul down cable (5*c*) and hook (4) which is attached to a large padeye in the center of the dish to maintain tension and insure proper seating and sealing between platform and caisson.

A seat (28) is welded to the upper rim of the dish of the platform and a seat (27) is welded to the rim of the caisson. Rubber seal (29) is fitted in a groove in seat (27) and provides the water tight seal between the caisson and the platform. The sloped shape of the upper part of stiffener (8) acts as a lead in as the caisson progresses onto the platform.

A sleeve (18) and a threaded ring (19) are installed over the blowout preventors so that the drill string may be passed through the sleeve and through the blowout preventor to carry out the drilling operation.

A number of sleeves equal to the number of blowout preventers on a subsea satellite station will permit the drilling of all wells from the caisson through the platform.

Portions of the lower part of the caisson are the seawater pressure resistant shell wall (21), a conical pressure resistant shell (23) welded to the elliptical shell portion providing the end wall of the caisson and Tee shaped ring stiffeners (22) at longitudinal intervals along the caisson.

Figure 3:
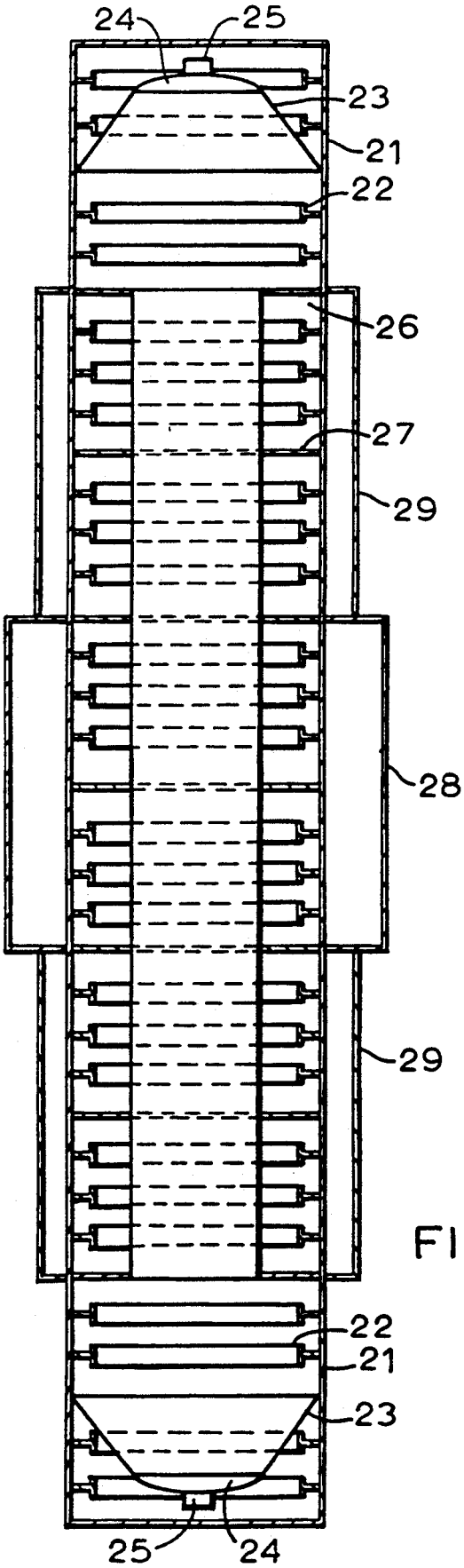
FIG. 3 is a cross sectional view of the cylindrical caisson structure showing structural shell, internal and external ballast tanks and service tanks, structural stiffeners, upper and lower end closures and syntactic foam providing flotation.

FIG. 3 shows details of the structure of a mobile submersible caisson. It is a cylindrical steel pressure vessel shell (21) passing the full length of the structure from top to bottom when in the vertical position. Near each end of the caisson closures are provided consisting of a conical shell (23) attached to the caisson shell wall at one end and capped at the other end by a ellipsoidal shell (24). Hatches (25) are built into the ellipsoidal shell to provide entrance and exit from the unit. The hatches at the upper end of the caisson, when it is in the vertical position on the surface, can be used for loading drilling material such as drilling rods and tubular goods for storage in the caisson. When the caisson is on the sea bottom, the hatch is available for use by submarine elevators and passenger submarines. The hatch at the lower end of the caisson is used as an access to the dish of the preset platform and the shell area of the caisson beyond the lower level of the bottom closure when the water has been pumped out after the caisson is sealed. This provides work space at 1 atmosphere for working on the drilling and completion equipment which will be permanently installed on the platform. The beam stiffeners (22) are provided to prevent the collapse of the cylindrical shell from elastic instability.

Annular fluid tanks (26) inside the caisson shell are intended to contain water or drilling mud slurry to be used in the drilling process. The water in tanks is provided for ballast and for trimming purposes. The annular tanks are separated to prevent the mixing of water and slurry, and diaphragms (27) separating the tanks also act as supports for the shell wall.

An annular fluid tank (28) is placed exterior to the shell of the caisson at the middle of the longitudinal section. The tank contains a variable amount of sea water to properly control the buoyancy of the caisson when it is rising from or descending to the platform. This tank is a sea depth withstanding pressure structure, and may be referred to as a variable ballast tank.

Piping systems and manifolds are provided for filling and emptying tanks containing water and mud slurry to ensure proper trim and ballast as the material and slurry are placed into the well. Pumps are provided to move the fluids.

Exterior annular cylinders (29), above and below the exterior fluid tank, are made of syntactic foam, which has a density of 44 #/cu. ft. and providing a net buoyancy of 20 #/cu. ft. when submersed in sea water having a density of 64 #/cu. ft. The material provides permanent trim adjustments in conjunction with the external variable ballast tanks.

Figure 4B:
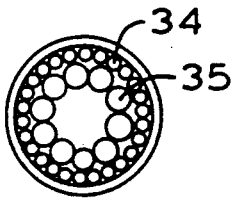
FIG. 4 is a cross sectional view of the major machinery and material used in the drilling and completing of the oil wells at the site.
Figure 4A:
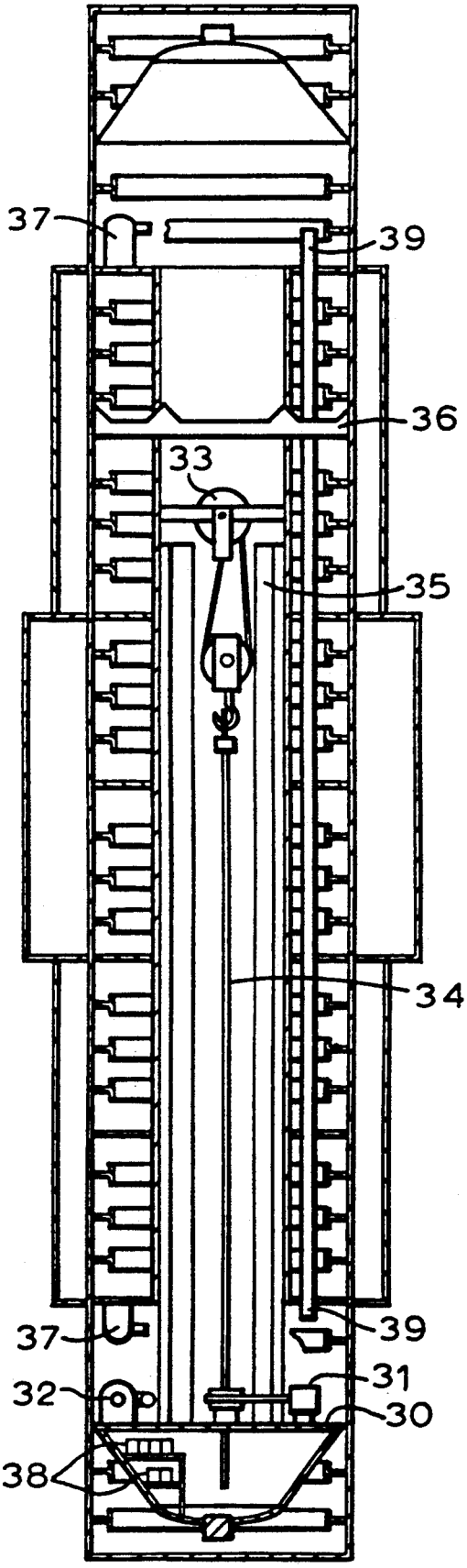

FIG. 4 shows machinery installed in the caisson; major pieces of machinery and mechanisms are identified in the figure. A drilling floor (30) which contains the machiner and motors to rotate the drilling equipment (31) are located in the lower end of the vertically standing caisson. The drilling floor also supports the mud pumps (32) which force the fluid mud into the well and which remove the cuttings of the rock in the drilling process. A winch (33) is provided at the upper end of the caisson to handle drilling rods (34) and tubular goods (35) which are used in drilling and lining the well.

Life support systems are provided which maintain proper one atmosphere comfort conditions in the space by a bulkhead (36) above the winch. The working spaces are below the bulkhead. The bulkhead is capable of resisting sea pressure either from above or from below to provide safe space in the event of flooding.

Air conditioning equipment (37) provides heating and cooling in the caisson. Air scrubbing systems and instrumentation are provided to remove toxic substances and gases from the atmosphere.

A bank of electric storage batteries (38) provides backup electric power in addition to the external power sources to operate the machinery and provide lighting in the caisson. Power is a significant requirement for all caissons since machinery and life support equipment are functioning at all times to provide safety and continuity of operations. Several methods for providing power are available. Power generated on shore or on shipboard may be either connected to the caisson or platform. A nuclear power plant in a stand-alone caisson on the preset platform adjacent to the machinery caissons can also provide power by the reactor, boiler, turbines and generators with necessary connections and auxiliaries inside of the caisson. The battery system will remain as backup system.

Piping and pumping systems are provided to control the ballasting of the caisson and the movements of the fluids and slurries needed for the submerged drilling process.

An elevator shaft (39) and elevator is provided for movement of personnel from the drilling floor to the crew's quarter. The elevator shaft is a pressure tight container to resist flooding.

Figure 5:
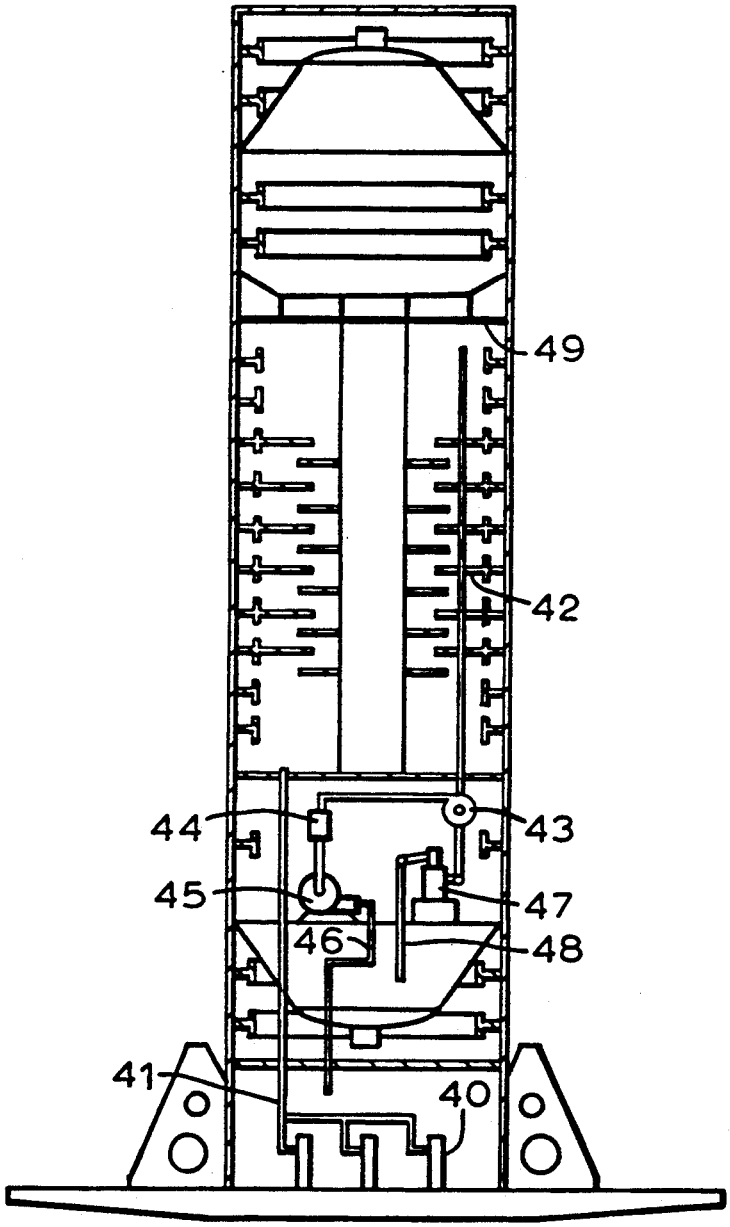
FIG. 5 is a cross sectional view of a caisson containing a separator and pumping and compressing equipment for delivering separated gas and oil though pipelines to the shore.

FIG. 5 shows a caisson which contains separation and transportation devices which separate and transport the petroleum products to shore after the wells have been drilled and completed by a drilling caisson. Completion equipment (40) which has replaced the blowout preventor equipment passes the products through a pipeline (41) to the separation section of the caisson. The products contain petroleum oil, gas, sand, water and other contaminants from the formation, and they are separated out by baffles (42), centrifuges (43), and filters (44). The principal activity is the separation of gas from oil, the oil being pumped by a pump (45), and pipeline (46) to shore while the gas is compressed in a compressor (47) and pipeline (48) carries the gas to shore. Sand, water and other contaminants are separated and discharged overboard.

The separation caisson has a horizontal bulkhead (49) at the top of the separator. The area above the bulkhead is the crew's quarters. The design of the separator caisson is patterned after the drilling caisson. Machinery and power for the necessary equipment requirements are provided.

Figure 6:
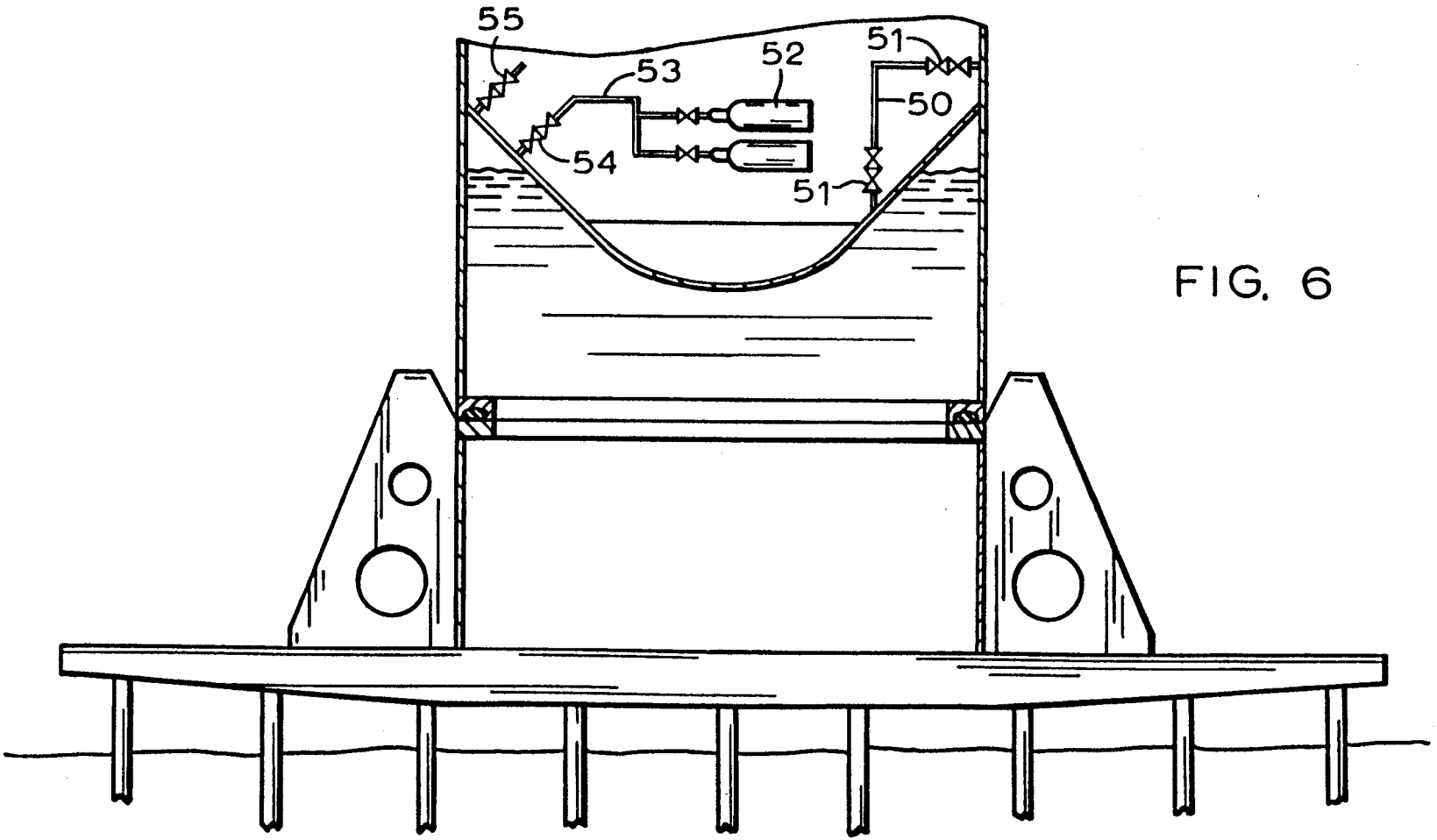
FIG. 6 is a piping diagram showing the method for sealing the caisson to the platform without doing damage to the structural elements.

FIG. 6 demonstrates the method for seating and sealing the caisson and the platform together. Methods for connecting rescue chambers and rescue submarine hatches have been well documented in the technical literature. This technique is also capable of connecting the caisson to the preset platform on the sea bottom and also capable of connecting two or more modules together for exchange of person, equipment and material as required. When seating a rescue chamber on a submarine, the load on the submarine structure is relatively small. The sudden application of a load the size that a caisson could exert on the skirt and foundation areas could cause damage to the structure if the pressure loading is instantaneous, i.e., if vented while filled solid with water. A procedure is followed to reduce the rate of applying load on the platform structure.

A pipeline (50) containing stop valves (51) is opened to provide a passage between the platform and lower portion to the open sea immediately prior to seating the caisson and platform together. A bank of air flasks (52) connected by a pipeline (53) containing stop valves (54) blow air into the dish space, blowing a small amount of the water out to the sea. The overboard discharge line is then stopped off by valves (51) and the airbank valves are closed. Valve (55) is then opened to admit the air slowly into the caisson, slowly reducing the pressure of the water in the dish space and causing sealing between the caisson and platform. Once the seal is effected, the water in the dish space is pumped overboard to provide access to the equipment in the dish. This procedure avoids sudden pressure loading on a very large area of caisson and platform resulting from sudden pressure reduction in the dish.

We claim:

1. A method of providing a low-pressure chamber on the floor of a body of water, at which the ambient water pressure is high, comprising:

A) providing a foundation structure, having an exterior surface, on the floor of a body water;

B) providing a caisson having a low-pressure interior first chamber and having an exterior surface whose shape is adapted to form a second chamber with the exterior surface on the foundation structure;

C) mating the caisson and foundation-structure external surface to form the second chamber;

D) introducing pressurized gas into the second chamber while permitting water to leave the second chamber in response; and E) venting fluid from the second chamber into the first chamber until the pressures in the two chambers have substantially equalized.

* * * * *